United States Patent [19]

Stern et al.

[11] Patent Number: 4,816,787

[45] Date of Patent: Mar. 28, 1989

[54] MILLIMETER WAVE MICROSTRIP PHASE SHIFTER

[75] Inventors: Richard A. Stern, Allenwood; Richard W. Babbitt, Fairhaven, both of N.J.

[73] Assignee: The United States of America as represented by the Secretary of the Army, Washington, D.C.

[21] Appl. No.: 152,206

[22] Filed: Feb. 3, 1988

[51] Int. Cl.[4] ..... H01P 1/215

[52] U.S. Cl. ..... 333/158; 333/24.1

[58] Field of Search ..... 333/24.1, 158

[56] References Cited

U.S. PATENT DOCUMENTS 4,458,218 7/1984 Babbitt et al. ..... 333/158

FOREIGN PATENT DOCUMENTS 2580429 10/1986 France ..... 333/158

OTHER PUBLICATIONS

*Amm-Wave Homogeneous Ferrite Phase Scan Antenna*, Stern et al, Microwave Journal, Apr. 1987, pp. 101, 102, 104, 106 & 108.

*Primary Examiner*—Paul Gensler

*Attorney, Agent, or Firm*—Sheldon Kanars; Robert A. Maikis

[57] ABSTRACT

A microstrip reciprocal phase shifter is provided comprising a rectangular ferrite rod having an upwardly sloping ramp member at one end thereof and a downwardly sloping ramp member at the other end thereof. The ramp members are made of dielectric waveguide having a dielectric constant substantially the same as the dielectric constant of the rod. The rod and ramp members are disposed on one surface of a microstrip dielectric substrate having a dielectric constant substantially lower than the dielectric constant of the ramp members and a ground plane on the other surface thereof. Input and output sections of microstrip conductor are placed on the surface of the substrate in axial alignment with the rod and ramp members. A dielectric plate having a dielectric constant substantially less than the rod is placed on top of the rod and another section of microstrip conductor is placed on top of the dielectric plate and the two ramp members and is electrically interconnected with the input and output microstrip conductors. A helical coil is arranged to surround the rod and plate to produce a unidirectional magnetic field along the longitudinal axis of the rod to thereby cause the rod to act as a Reggia-Spencer type of ferrite phase shifter.

4 Claims, 1 Drawing Sheet

MILLIMETER WAVE MICROSTRIP PHASE SHIFTER

STATEMENT OF GOVERNMENT RIGHTS

The invention described herein may be manufactured, used and licensed by or for the Government for governmental purposes without the payment to us of any royalties thereon.

BACKGROUND OF THE INVENTION

1. Field of the Invention

This invention relates to microstrip transmission lines and microstrip transmission line components operating in the millimeter wave region of the frequency spectrum and more particularly to a microstrip reciprocal phase shifter for use with such microstrip transmission lines and microstrip components.

2. Description of the Prior Art

Phase shifters are devices employed to perform a phase shift function in many types of RF circuits. For example, in the millimeter wave region of the frequency spectrum phase shifters are employed with phased antenna arrays for radar and communications applications as well as for differential phase shift circulators and switches. Since much of the equipment in this region of the frequency spectrum is designed with planar circuitry utilizing microstrip transmission lines and components, a need has arisen for a suitable microstrip phase shifter capable of being used with this equipment. Although millimeter wave ferrite rod reciprocal phase shifters, such as that shown and described in U.S. Pat. No. 4, 458,218 issued July 3, 1984 to the applicants of the present application and assigned to the assignee of the present application, for example, have been developed for use with millimeter wave frequency applications utilizing the dielectric waveguide medium, there is presently not available a millimeter wave reciprocal phase shifter suitable for use with the aforementioned planar circuitry which uses the microstrip transmission line medium. Since the microstrip transmission components used in applications in this extremely high frequency area of the frequency spectrum are consequently of extremely small size and low weight, they are often difficult to fabricate and assemble using automated techniques. Accordingly, a suitable microstrip phase shifter should be capable of being fabricated relatively easily and inexpensively and of being installed in the planar circuit applications relatively easily and inexpensively to minimize overall equipment cost. Additionally, a suitable microstrip phase shifter should also exhibit a relatively low insertion loss in the millimeter wave region of the frequency spectrum.

SUMMARY OF THE INVENTION

It is an object of this invention to provide a microstrip reciprocal ferrite phase shifter which is suitable for use in the millimeter wave region of the frequency spectrum.

It is a further object of this invention to provide a millimeter wave microstrip reciprocal phase shifter of extremely small size and low weight which can be both fabricated and installed in microstrip transmission line applications relatively easily and inexpensively.

It is a still further object of this invention to provide a microstrip reciprocal ferrite phase shifter which has a relatively low insertion loss in the millimeter wave region of the frequency spectrum.

It is another object of this invention to provide a millimeter wave microstrip reciprocal ferrite phase shifter which is especially suited for use in microstrip phased antenna arrays, differential phase shift circulators and switches.

Briefly, the microstrip reciprocal phase shifter of the invention comprises a length of microstrip transmission line dielectric substrate having top and bottom planar surfaces. An electrically conductive ground plane is mounted on the bottom surface of the substrate. First and second lengths of electrically conductive microstrip conductor are mounted on the top surface of the substrate in longitudinal alignment with each other and spaced a distance apart by a longitudinally extending gap so that one end of each of the lengths of microstrip conductor defines a different end of the gap. A ferrite rod having a rectangular cross-section, a length shorter than the length of the gap and a dielectric constant greater than the dielectric constant of the substrate is mounted on the top surface of the substrate in longitudinal alignment with the lengths of microstrip conductor and with one of the four sides of the rod abutting the substrate top surface. The ends of the rod are spaced substantially equidistant from the ends of the gap. A dielectric plate is mounted on a second side of the rod which is parallel to the first-named rod side. The plate extends the length of the rod and has a dielectric constant which is substantially the same as the dielectric constant of the substrate. A pair of ramp-shaped dielectric waveguide members are mounted on the top surface of the substrate at opposite ends of the rod and occupy the spaces between the ends of the rod and the ends of the gap. Each of the ramps has a dielectric constant which is substantially the same as the dielectric constant of the rod, a width which is substantially the same as the width of the rod, a planar bottom surface abutting the top surface of the substrate and a downwardly sloping planar top surface extending between the ends of the plate and the ends of the gap. A third length of electrically conductive microstrip conductor is mounted on the top surface of the ramps and the top surface of the plate and extends between the ends of the gap. The third length of microstrip conductor has the ends thereof electrically connected to said one end of the first and second lengths of microstrip conductor defining the ends of the gap so that the third length of microstrip conductor is serially interconnected with the first and second lengths of microstrip conductor. Finally, means are provided for applying a unidirectional magnetic field along the longitudinal axis of the rod whereby the other ends of the first and second lengths of microstrip conductor act as the input and output terminals of the phase shifter and electromagnetic wave energy travelling from the input terminal of the phase shifter to the output terminal thereof is shifted in phase by an amount proportional to the strength of the magnetic field.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
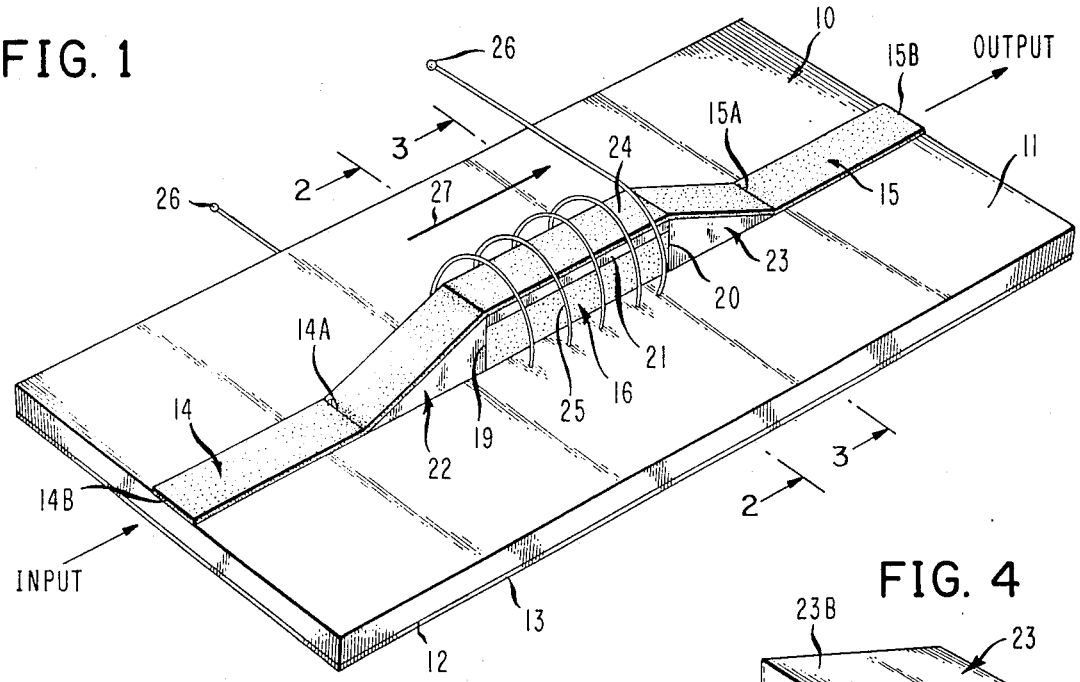
FIG. 1 is a perspective view of the microstrip reciprocal phase shifter of the invention.
Figure 2:
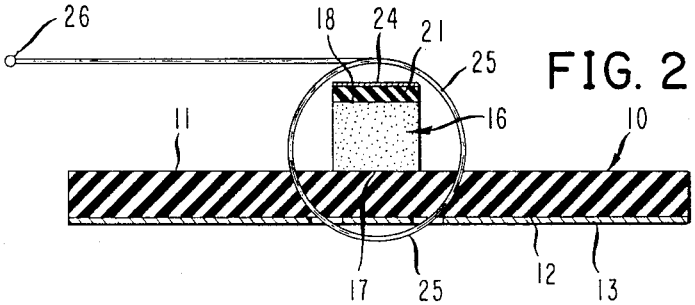
FIG. 2 is a full sectional view of the phase shifter taken along the line 2—2 of FIG. 1.
Figure 3:
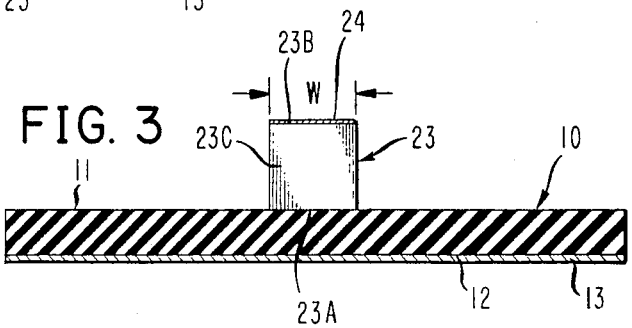
FIG. 3 is a full sectional view of the phase shifter taken along the line 3—3 of FIG. 1.

Referring now to FIGS. 1–3 of the drawings, there is shown a microstrip reciprocal phase shifter constructed in accordance with the present invention comprising a length of microstrip transmission line dielectric substrate, indicated generally as 10, having a planar top surface 11 and a planar bottom surface 12. The substrate 10 may, for example, comprise a section of conventional microstrip transmission line substrate which is approximately 0.010 inch thick and which is fabricated of duroid or other similar dielectric material having a relatively low dielectric constant. An electrically conductive ground plane 13 which is fabricated of a good conducting metal, such as copper or silver, for example, is mounted on the bottom surface 12 of the substrate and covers that entire surface.

First and second lengths of electrically conductive microstrip conductor, indicated as 14 and 15, respectively, are mounted on the top surface 11 of the substrate in longitudinal alignment with each other and spaced a distance apart by a longitudinally extending gap. As may be seen in FIG. 1, the first and second lengths of microstrip conductor 14, 15 are longitudinally aligned with each other and with the labelled "Input" and "Output" arrows. One end 14A of the first conductor length 14 defines one end of the longitudinally extending gap while one end 15A of the second length of conductor 15 defines the other end of the gap. The microstrip conductor lengths 14 and 15 should be fabricated of a good electrical conductor such as copper or silver, for example.

A ferrite rod, indicated generally as 16, which has a rectangular cross-section is mounted on the top surface 11 of the substrate 10 in longitudinal alignment with the lengths 14, 15 of microstrip conductor and has one of the four sides of the rod (the bottom side 17 as shown in FIG. 2) abutting the substrate top surface 11. The ferrite rod 16 has a top surface 18 which is parallel to the bottom surface 17 and a length which is shorter than the length of the gap. The ends 19 and 20 of the rod are spaced substantially equidistant from the ends of the gap. The rod 16 is fabricated of a ferrite material, such as nickel zinc ferrite or lithium zinc ferrite, for example, which exhibits gyromagnetic behavior in the presence of a unidirectional magnetic field. The dielectric constant of the ferrite rod 16 is greater than the dielectric constant of the substrate 10. For example, if the substrate is fabricated of duroid, it would have a dielectric constant of 2.2 and if the ferrite rod is fabricated of nickel zinc ferrite, the rod would have a dielectric constant of 13.

As seen in FIGS. 1 and 2, a dielectric plate 21 is mounted on the top surface 18 of the ferrite rod 16 and extends the length of the rod. Since the rod side 18 is parallel to the rod side 17, the dielectric plate 21 will be parallel to the top surface 11 of the substrate 10. The dielectric constant of the plate 21 is preferably substantially the same as the dielectric constant of the substrate 10 and, for example, the plate may be conveniently fabricated of duroid. Although, for convenience of illustration, the thickness of the plate 21 is shown as being substantial in FIGS. 1 and 2, in practice the plate need only comprise a relatively thin plate.

Figure 4:
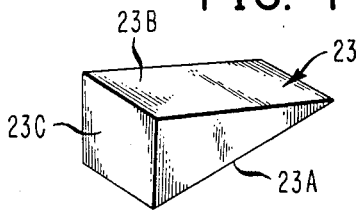
FIG. 4 is a perspective view of one of the ramp-shaped dielectric waveguide members shown in FIGS. 1 and 3.

As seen in FIGS. 1–4 of the drawings, a pair of ramp-shaped dielectric waveguide members, indicated generally as 22 and 23, are mounted on the top surface 11 of the substrate at the opposite ends 19 and 20 of the rod and are arranged to occupy the spaces between the ends 19, 20 of the rod and the ends of the gap which are defined by the microstrip conductor ends 14A, 15A. Each of the ramp-shaped members 22, 23 has a width W, as seen in FIG. 3, which is substantially the same as the width of the rod 16, a planar bottom surface which abuts the top surface 11 of the substrate and a downwardly sloping planar top surface which extends between the ends of the plate and the ends of the gap. For example, the ramp-shaped member 23 is shown in FIGS. 3 and 4 of the drawings and is seen to have a bottom surface 23A which abuts the top surface 11 of the substrate 10 and a downwardly sloping planar top surface 23B which extends between the end of the plate which is adjacent rod end 20 and the end of the gap which is defined by end 15A of the second length 15 of microstrip conductor. The end 23C of ramp-shaped member 23 abuts the end 20 of the ferrite rod 16 and the corresponding end of the dielectric plate 21. The ramp-shaped dielectric waveguide members 22 and 23 should be fabricated of a material having a dielectric constant which is substantially the same as the dielectric constant of the ferrite rod 16. For example, if the ferrite rod is fabricated of nickel zinc ferrite, the ramp-shaped members 22, 23 may be conveniently fabricated of magnesium titanate which also has a dielectric constant of 13.

A third length of electrically conductive microstrip conductor 24 is mounted on the top surface of ramp-shaped member 22, the top surface 23B of ramp-shaped member 23 and the top surface of the dielectric plate 21 as shown in FIGS. 1–3 of the drawings. The third length of conductor 24 extends between the ends of the gap which are defined by the ends 14A and 15A of the first and second lengths of microstrip conductor. The ends of the third length of microstrip conductor 24 are electrically connected to the ends 14A and 15A of the first and second lengths of conductor by any convenient means, such as soldering, for example, not illustrated, so that the third length of microstrip conductor is serially interconnected with the first and second lengths of microstrip conductor. In practice, each of the first, second and third lengths of microstrip conductor may comprise a section of a single integral length of microstrip conductor which extends continuously from the Input terminal 14B of the phase shifter to the Output terminal 15B of the shifter or each of the first, second and third lengths of microstrip conductor may comprise a separate length of microstrip conductor, as illustrated in the drawings.

Finally, the invention contemplates means for applying a unidirectional magnetic field which extends along the longitudinal axis of the ferrite rod 16 for reasons which will be explained hereinafter. As illustrated in FIGS. 1 and 2, the aforementioned means may take the form of a helical coil 25 which encircles the dielectric plate 21 and the ferrite rod 16 and extends along the length of the rod. As seen in FIG. 2 of the drawings, the turns of the coil 25 are embedded in and pass through the substrate 10 and also pass through small apertures in the ground plane 13. The turns of the coil should be spaced a distance from the ferrite rod 16 and the dielectric plate 21 with the microstrip conductor length 24 on its top surface for proper operation of the phase shifter. When the terminals 26 of the coil 25 are connected to a source of d.c. voltage of proper polarity, a magnetic field represented by the arrow 27 will be formed which extends the length of the ferrite rod 16. The magnitude and direction of the magnetic field 27 may be controlled by the amplitude and polarity, respectively, of the d.c. voltage applied to the coil terminals.

In operation, when a millimeter wavelength signal is applied to the Input terminal 14B of the phase shifter, it is transmitted along the first length 14 of microstrip conductor since that in conjunction with the ground plane 13 and the dielectric substrate 10 form a short section of a conventional microstrip transmission line. At end 14A of the microstrip conductor length 14, the applied signal passes along a microstrip transmission line which is formed by the portion of microstrip conductor length 24 which is on the upwardly sloping top surface 22B of the ramp-shaped member 22 and the ground plane and the dielectric substrate. However, as the signal is progressing up the incline it begins to become transmitted by the solid dielectric waveguide material of the ramp-shaped member 22 because the dielectric constant of the ramp-shaped member is substantially greater than the dielectric constant of the substrate 10. When the signal enters that portion of microstrip conductor length 24 which is supported by the dielectric plate 21 which lies on the top surface of the ferrite rod 16, the signal becomes completely captured by the ferrite rod 16 which acts as a solid dielectric waveguide having the same or substantially the same dielectric constant as the ramp-shaped member 22. As may be seen in FIGS. 1 and 2 of the drawings, the ferrite rod 16 is "sandwiched" between the electrically conductive ground plane 13 and the microstrip conductor length 24 and is insulated from these conductive elements by the dielectric substrate 10 and the dielectric plate 21, respectively. Accordingly, when the ferrite rod 16 is subjected to a unidirectional magnetic field along its longitudinal axis, it will function as a reciprocal phase shifter because of the suppressed rotation or Reggia-Spencer effect in substantially the same manner as the dielectric waveguide phase shifter described in said U.S. Pat. No. 4,458,218. It will be noted, however, that in the present invention, the electrically conductive ground plane 13 and the electrically conductive microstrip conductor length 24 serve the dual functions of forming a section of the microstrip transmission line and of acting as the electrically conductive, metallic plates which are necessary to produce the aforementioned Reggia-Spencer effect.

The magnitude of the phase shift introduced by the phase shifter of the invention may be controlled by controlling the magnitude of the d.c. voltage applied to the terminals 26 of the coil 25. Since the phase shifter of the invention is a true reciprocal phase shifter, a reversal of the polarity of the control voltage applied to the coil terminals will not produce a reversal in phase. For example, if a control voltage range of one polarity produces a positive range of phase shift, a reversal of control voltage polarity over the same range will still produce a range of positive phase shift.

After the phase shifting action of the ferrite rod 16 takes place, the signal passes through the downwardly sloping ramp-shaped member 23 where transmission is gradually converted from the dielectric waveguide mode of transmission to the microstrip transmission line mode of transmission so that by the time the signal passes along the length 15 of microstrip conductor and reaches the Output terminal 15B of the phase shifter it will again be completely in the microstrip transmission mode.

Figure 5:
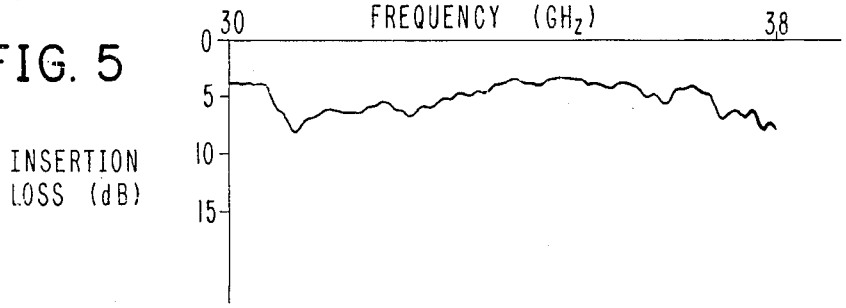
FIG. 5 is a graph showing insertion loss as a function of frequency over a selected frequency range for a prototype microstrip reciprocal phase shifter constructed in accordance with the teachings of the invention.

FIG. 5 of the drawings shows the insertion loss in decibels in the 30 to 38 GHz region of the frequency spectrum for a phase shifter constructed in accordance with the teachings of the present invention which was measured in a test fixture employing metal waveguide transitions to microstrip and lengths of lead-in microstrip. As may be seen, the total loss of this test section was 2.8 dB. Considering, however, the insertion losses introduced by the metal waveguide transitions and lengths of lead-in microstrip, it is expected that the actual loss of the phase shifter was less than 1.5 dB. In order to minimize the insertion loss, the ends of the ramp-shaped members should be joined to the adjacent ends 19 and 20, respectively, of the ferrite rod 16 by a low loss epoxy or adhesive such as Scotch-Weld Structural Adhesive as marketed by the 3M Company of St. Paul, Minn., for example. It is estimated that the phase shifting capability of the phase shifter of the invention is at least 360 degrees phase shift per inch of ferrite rod length.

It is believed apparent that many changes could be made in the construction and described uses of the foregoing microstrip reciprocal phase shifter and many seemingly different embodiments of the invention could be constructed without departing from the scope thereof. For example, although the phase shifter has been described with reference to use in the millimeter wave region of the frequency spectrum, it is apparent that the shifter is not limited in use to applications solely in this frequency region. Accordingly, it is intended that all matter contained in the above description or shown in the accompanying drawings, shall be interpreted as illustrative and not in a limiting sense.

What is claimed is:

1. A microstrip reciprocal phase shifter comprising a length of microstrip transmission line dielectric substrate having top and bottom planar surfaces;

an electrically conductive ground plane mounted on the bottom surface of said substrate;

first and second lengths of electrically conductive microstrip conductor mounted on the top surface of said substrate in longitudinal alignment with each other and spaced a distance apart by a longitudinally extending gap so that one end of each of said lengths of microstrip conductor defines a different end of said gap;

a ferrite rod having a rectangular cross-section, a length shorter than the length of said gap and a dielectric constant greater than the dielectric constant of said substrate, said rod being mounted on the top surface of said substrate in longitudinal alignment with said lengths of microstrip conductor and with one of the four sides of the rod abutting said substrate top surface, the ends of said rod being spaced substantially equidistant from the ends of said gap;

a dielectric plate mounted on a second side of said rod which is parallel to said first-named rod side, said plate extending the length of the rod and having a dielectric constant which is substantially the same as the dielectric constant of said substrate;

a pair of ramp-shaped dielectric waveguide members mounted on the top surface of said substrate at opposite ends of said rod and occupying the spaces between the ends of said rod and the ends of said gap, each of said ramps having a dielectric constant which is substantially the same as the dielectric constant of said rod, a width which is substantially the same as the width of said rod, a planar bottom surface abutting the top surface of said substrate and a downwardly sloping planar top surface extending between the ends of said plate and the ends of said gap;

a third length of electrically conductive microstrip conductor mounted on the top surfaces of said ramps and the top surface of said plate and extending between the ends of said gap, said third length of microstrip conductor having the ends thereof electrically connected to said one end of said first and second lengths of microstrip conductor defining the ends of said gap so that said third length of microstrip conductor is serially interconnected with said first and second lengths of microstrip conductor; and means for applying a unidirectional magnetic field along the longitudinal axis of said rod, whereby said other ends of said first and second lengths of microstrip conductor act as the input and output terminals of said phase shifter and electromagnetic wave energy traveling from the input terminal of said phase shifter to the output terminal thereof is shifted in phase by an amount proportional to the strength of said magnetic field.

2. A microstrip reciprocal phase shifter as claimed in claim 1 wherein said means for applying a unidirectional magnetic field along the longitudinal axis of said rod comprises a helical coil encircling said plate and said rod and extending along the length of the rod, the turns of said coil passing through said substrate and said ground plane and being spaced a distance from said rod and said plate.

3. A microstrip reciprocal phase shifter as claimed in claim 1 wherein each of said first, second and third lengths of microstrip conductor comprises a section of a single integral length of microstrip conductor.

4. A microstrip reciprocal phase shifter as claimed in claim 1 wherein each of said first, second and third lengths of microstrip conductor comprises a separate length of microstrip conductor and said three separate lengths of microstrip conductor are electrically connected together at the ends of said gap by electrical connection means.

* * * * *